US005310378A

United States Patent [19]

Shannon

[11] Patent Number: 5,310,378

[45] Date of Patent: May 10, 1994

[54] TRANSFORMABLE TOY

[76] Inventor: Suel G. Shannon, 16 South St., Rockport, Mass. 01966

[21] Appl. No.: 891,720

[22] Filed: Jun. 1, 1992

[51] Int. Cl.[5] ..... A63H 3/02; A63H 3/04; A63H 3/46

[52] U.S. Cl. ..... 446/268; 446/72; 446/80; 446/371; 446/375; 446/378; 446/382; 446/487; 446/370

[58] Field of Search ..... 446/72, 80, 268, 370, 446/371, 375, 378, 380, 379, 382, 376, 487

[56] References Cited

U.S. PATENT DOCUMENTS

| | | | |
|---|---|---|---|
| 152,250 | 6/1874 | Powers | 446/487 X |
| 2,195,127 | 3/1940 | Brucker . | |
| 3,284,947 | 11/1966 | Dahl | 446/374 |
| 4,062,144 | 12/1977 | Holden et al. . | |
| 4,413,442 | 11/1985 | McSweeney . | |
| 4,563,159 | 1/1986 | Hills et al. | 446/74 |
| 4,674,990 | 6/1987 | Ohno | 446/376 |
| 4,696,656 | 9/1987 | Torres et al. | 446/376 |
| 4,708,687 | 11/1987 | Goldberg et al. | 446/376 X |
| 4,722,712 | 2/1988 | McKenna | 446/487 X |
| 4,781,648 | 11/1988 | Garfinkel | 446/321 |
| 4,932,919 | 6/1990 | Shapero | 446/370 X |
| 5,090,935 | 2/1992 | Monson | 446/369 X |

FOREIGN PATENT DOCUMENTS

| | | | |
|---|---|---|---|
| 368815 | 5/1990 | European Pat. Off. | 446/487 |
| 2559072 | 8/1985 | France | 446/487 |
| 2120111 | 11/1983 | United Kingdom | 446/72 |
| 2184663 | 7/1987 | United Kingdom | 446/487 |

*Primary Examiner*—Danton D. DeMille
*Attorney, Agent, or Firm*—Don Halgren

[57] ABSTRACT

The toy is transformable into two distinct open and closed conditions (O, C) through a body and appendages each of a fixed geometric shape mentioned to collectively present the image of an identifiable animate object in the open condition (O) and an image of an inanimate object in the form of a rounded structure in the closed condition (C) through hinges connecting the body and the appendages to permit controlled relative movement of the appendages both for transformation and play in either configuration. Fasteners are provided to hold the toy in the closed configuration defining the inanimate image and upon release to allow the appendages to open relative to the body to define the open configuration and animate image.

9 Claims, 11 Drawing Sheets

FIG. 1
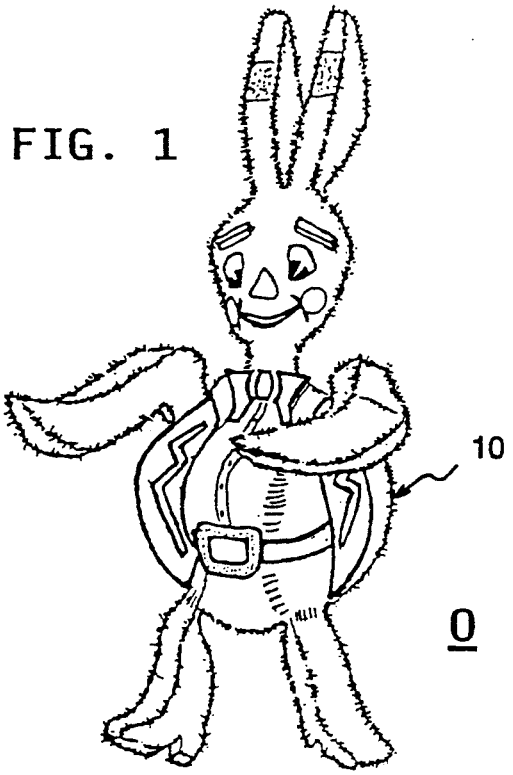
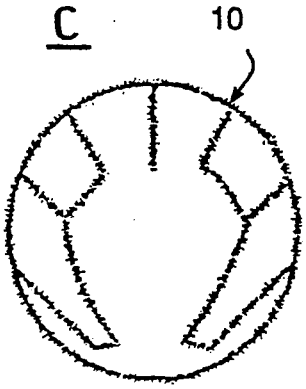
FIG. 1A
FIG. 2
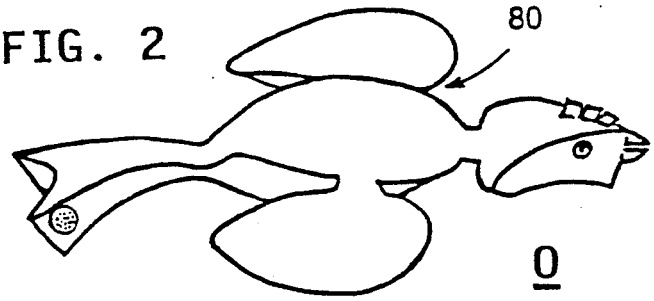
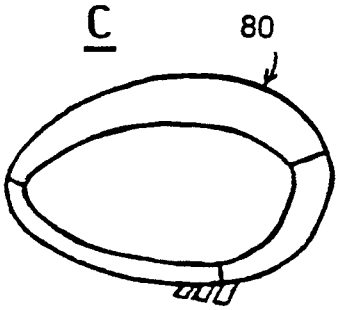
FIG. 2A
FIG. 3
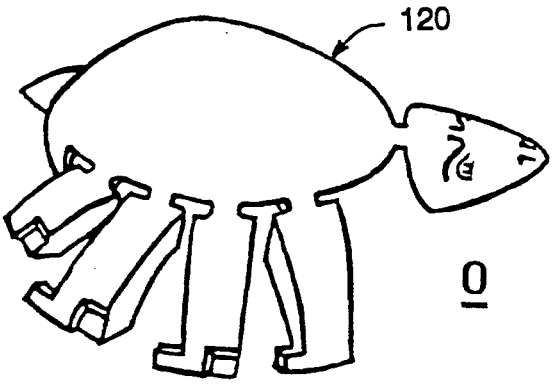
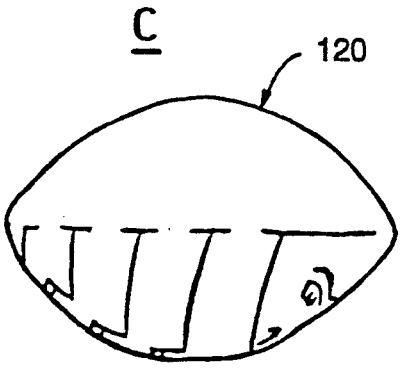
FIG. 3A

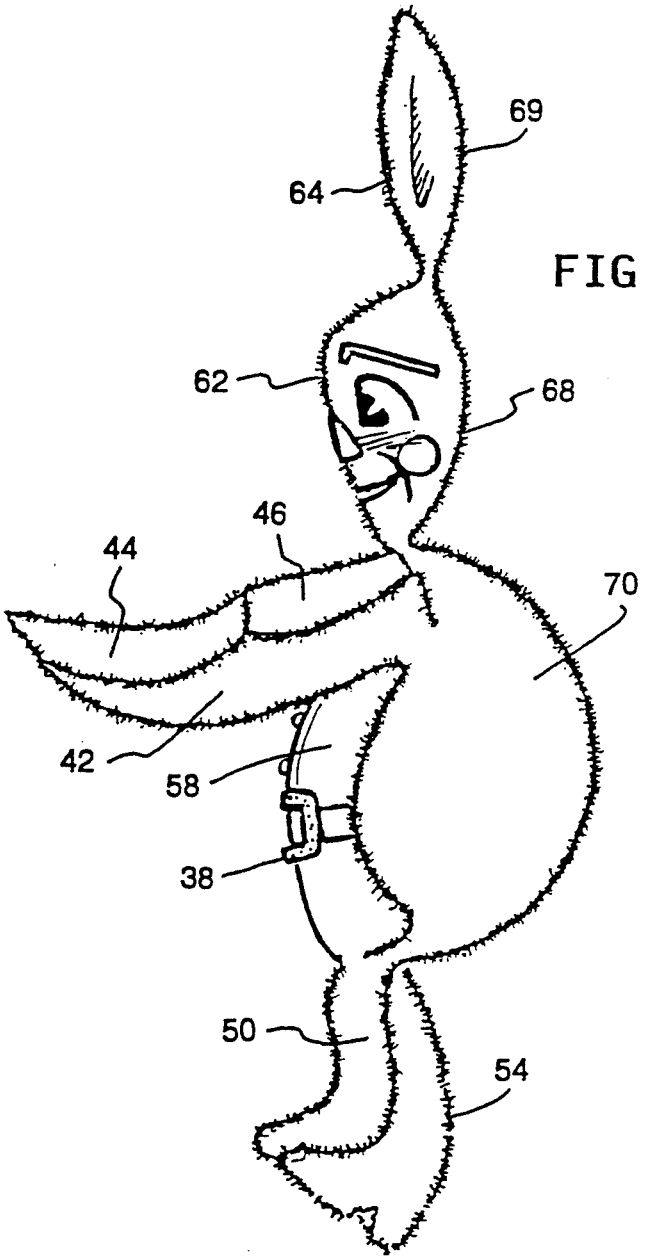
FIG. 10
FIG. 10A
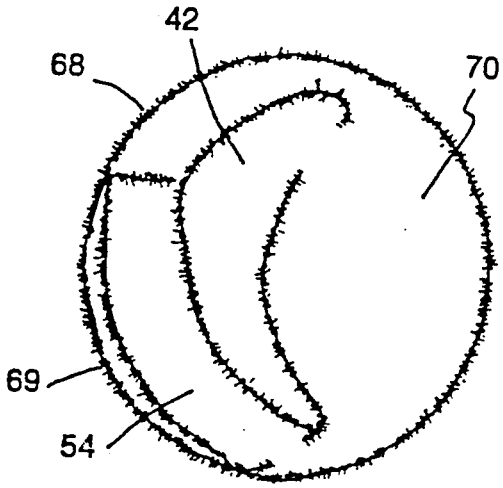

TRANSFORMABLE TOY

BACKGROUND OF THE INVENTION

1. Field of the Invention

This invention relates to a transformable toy.

2. Prior Art

The need for toys that intrigue through being transformable as between two or more configurations is evidenced by U.S. Pat. No. 4,674,990 granted Jun. 23, 1987, entitled "Reconfigurable Toy Assembly". There, a number of parts are pivotably and movably interconnected to provide a vehicle formed by folding and a robotic, humanoid form by being unfolded. The patent mentions the benefit to children's interest obtained through having such configurable toys and it mentions also the advantages of having such toys which can be transformed with ease by a simple operation and manufactured with low cost.

Another example is taught in U.S. Pat. No. 2,195,127, issued Mar. 26, 1940 and drawn to a reversible doll. There, a doll form has various arms and legs and a pair of heads secured together at common junctures wedded to a reversible skirt so that the doll can be reversed to present two distinctly different visual images. U.S. Pat. No. 4,563,159, issued Jan. 7, 1986, presents a toy convertible among multiple configurations, including a stuffed figurine, a stuffed tote bag which recedes entirely within the figurine. U.S. Pat. No. 4,781,648, issued Nov. 1, 1988, deals with a reversible plush toy; having a pair of substantially equal sized fabric skins peripherally secured and configured to selectively expose each skin while inclosing the other skin. Still another example of a three dimensional transformable toy is taught in U.S. Pat. No. 4,413,442, issued Nov. 8, 1983 which includes embodiments wherein one form of the image of an egg is presented which form can be opened out to provide the image of either a bird or a turtle. Referring to the first configuration as a closed ovid and the second configuration as a fanciful animal figure; change being achieved by passing the bulk of the toy through an opening. A closing means is taught utilizing mateable "VELCRO" strips. Finally, U.S. Pat. No. 4,062,144, issued Dec. 13, 1977, is included to represent a doll figure having flexible and pivotable arm members with hingedly connected segments and various members are made of foamed material. This patent teaches and refers to other patents including bendable or spring material incorporated in arms and legs and permitting limbs to be moved to various positions.

BRIEF SUMMARY OF THE INVENTION

The present invention represents an improvement over the foregoing and other prior art by providing a transformable toy having surfaces and geometries facilitating one configuration having a rounded exterior surface to form an inanimate object and, upon opening, a segmented configuration forming an animate object in appearance, both configurations being playable.

Another object is to provide a reversible, three-dimensional toy that can be easily and readily transformed through a construction that is readily manufactured.

Another object is to provide a reversible, three-dimensional, educational toy transformable between first and second shapes by a simple folding of hinges, that interconnect body and appendage parts.

Still a further object is to provide a reversible toy that is foldable, utilizing a common element to form multiple hinges.

A final object is to provide a foldable, transformable toy including spring elements operable to drive the segments of the toy to spring open upon release of a fastener holding the segments in a closed position.

SUMMARY OF THE INVENTION

The present invention achieves the foregoing objectives and provides an improvement over the prior art through a three dimensional toy structure which is reversibly transformable between a playable closed configuration having an exterior surface essentially entirely curvilinear and an open condition comprised of a playable object defined by it's internal surfaces. The toy includes a body and appendages, including a head, arms and/or legs and further appendage details formed of interior surfaces distinct from the exterior surface, which surfaces become entirely inwardly disposed upon folding of the appendages together against the body. The invention toy contemplates play with both configurations; as, for example, with the open configuration and an animate figure or, with the closed configuration by throwing, bouncing, or kicking; i.e., handleable toy.

Details of the animate object may be defined by shaping of the distinct surfaces, by printing, painting or otherwise adding color to effect a desired image. The body and appendages of the toy of the invention are made of a relatively rigid material to insure an essentially constant geometric shape to facilitate an easy internesting in it's closed condition. This defines the inanimate configuration of the toy to permit play. Hinges interconnecting the body and appendages facilitate relative movement for manipulation between configurations. The hinges are characterized by having a width substantially greater than their thickness to permit a relative movement of each appendage to be an essentially single arcuate track to make folded closure constant and simple, to assure that things fit together repeatedly in use and to make transformation from one configuration to the other simple for a child. Spring action in the hinges may be employed to surprise the user and to enhance play as well as education through such novelty.

The invention contemplates a variety of toy constructions including a one piece, integrally formed, molded plastic construction comprising the body, appendages and hinges. The invention may include an internal skeleton formed of flat sheet material. The skeleton and hinges have bulk added to provide three-dimensional shapes, by overmolding or by other addition of material; or, an exterior skeleton forming the skin and one of the distinct surfaces, inner or outer. Surface details may be added after the body has been formed, by transfer inks or dyes or paints applied to the surfaces of the device, or, in one embodiment, printed on a flat sheet of material that becomes one of the surfaces or the skin of one of the surfaces, bulk being added thereafter by overmolding.

Fasteners may be provided on the body, which allow the appendages thereon to be folded together and locked into a position defining the inanimate configuration of the toy. The fasteners are releasable to permit transformation from the closed inanimate configuration to the open animate configuration. In another embodiment the appendages are given intermating surfaces which allow a sequential closure with the various appendages interlocked to be held by a single fastener between the last appendage elements folded closed.

Methods of manufacture include providing internal or external skeletons overmolded and decorated; or printed upon for details then thermoformed and overmolded.

BRIEF DESCRIPTION OF THE DRAWINGS

FIG. 1 is a front elevational view of one toy of the present invention in an open configuration, depicting an animate rabbit-like object;

FIG. 1A is an elevational view of the toy shown in FIG. 1, in a closed configuration, depicting a curvilinear surfaced object that is inanimate, the transformation representation being that of a rabbit to a ball;

FIG. 2 is a perspective view of a second toy of the present invention in an open configuration, depicting an animate bird-like object;

FIG. 2A is an elevational view of the toy shown in FIG. 2, as a closed configuration, depicting a curvilinear surfaced object that is inanimate, the transformation representation being that of a bird to an egg;

FIG. 3 is a perspective view of a third toy of the present invention in an open configuration, depicting an animate insect-like object;

FIG. 3A is a side elevational view of the toy shown in FIG. 3, as a closed configuration, depicting a curvilinear surfaced object that is inanimate, the transformation representation being that of an insect to a football;

FIGS. 10 and 10A represent the side views of the object shown in FIG. 6 and in FIG. 9, respectively;

DETAIL DESCRIPTION OF THE INVENTION

Figure 4:
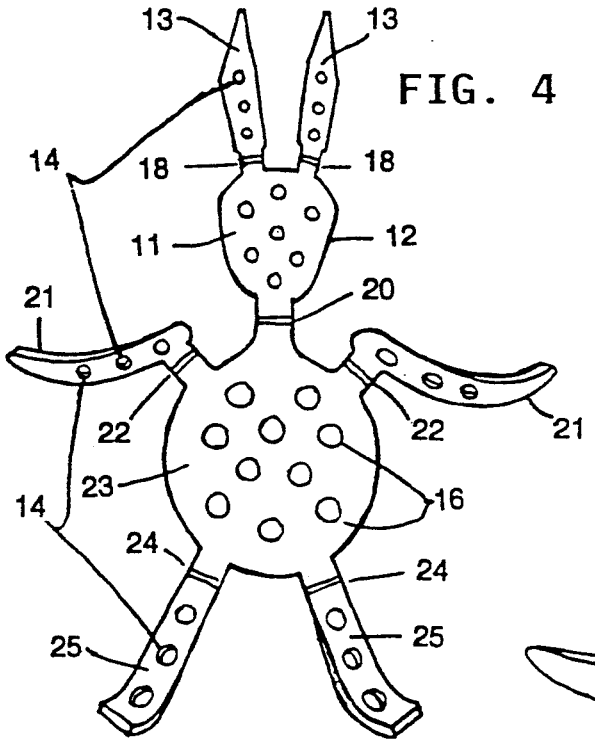
FIG. 4 is an elevational view of a skeleton for the toy shown in FIG. 1, end portions of appendages show slight perspective.

Referring now to FIGS. 1, 1A, 2, 2A, 3 and 3A, are illustrative representations of three different toys, a rabbit, a bird, and an insect, depicted in each of two configurations. The open configuration "O", shown in FIG. 1, depicts a rabbit toy 10, with a ball or rounded, closed shaped configuration "C" when closed, shown in FIG. 1*a*. FIG. 2, shows an open configuration of a bird toy 80 and the closed configuration, shown in FIG. 2A, depicts the bird toy 80 folded into an egg shape. In FIG. 3 an insect shaped toy 120 is shown in the open configuration "O" and is shown in FIG. 3A in the closed configuration "C" in a football shape. From these three FIGS., 1, 2 and 3, each of the toys, 10, 80 and 120 are shown as three-dimensional representations and each includes a body with various appendages including in the case of the rabbit, ears, a head, arms and legs. In the case of the bird 80, there is a body, and appendages including a head, a pair of wings and a tail. In the case of the insect 120 there is a body and a plurality of appendages and various legs. In each of the various body shapes, each head and appendages have exterior surfaces which when in the closed "C" configuration are contiguous to form the visible closed shape. Further, interior surfaces are distinct therefrom to form or carry artistic detail. With respect to the bird 80, shown in FIGS. 11-14, a three dimensional comb 81 is carried on it's exterior surface and with respect to the insect 120, shown in FIG. 18, a painted or otherwise coated representation of eyes and nose 130 is carried on the exterior surface. Also to be noted is the dimensioning and shaping of the various appendages relative to surfaces of the body so that the various appendages readily intermesh with respect to each other and with respect to the body to form a desirable closed shape, ball, egg, or football and an animate object when open, bunny, bird or insect, respectively.

Figure 25:
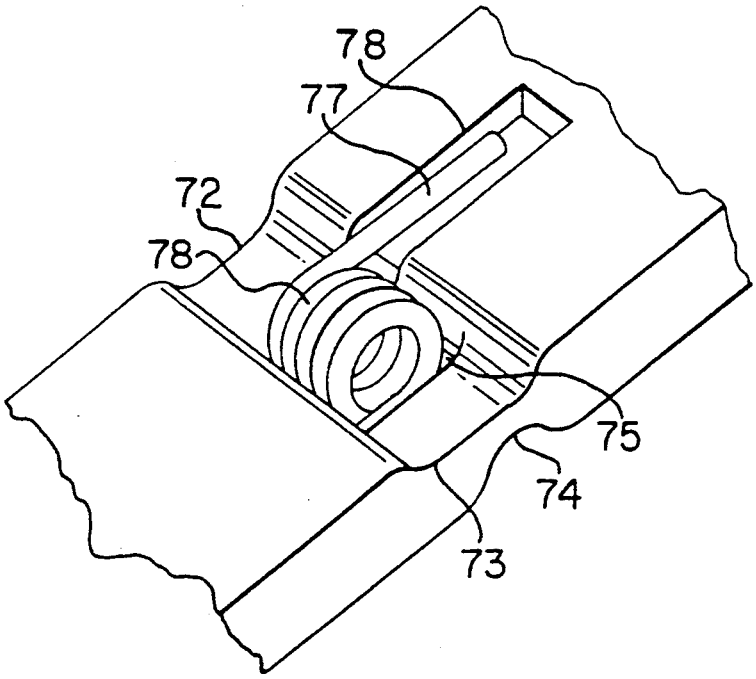
FIG. 25 is a partial perspective view of a hinge with a biasing means.

Referring now to FIG. 4, one embodiment of the invention toy begins with a skeleton 12 formed of a flat sheet material such as, for example, a thin sheet of polypropylene of about 0.050 to 0.125 inches thick. The thin sheet 12 may be molded or stamped and formed to include the desired outside profile including a plurality of apertures or holes 16 and 14 extending throughout the body and appendages, respectively, to facilitate the mechanical attachment of bulk material, as for example by overmolding the skeleton 12. The process of overmolding involves inserting a rigid or semi-rigid frame into a molding cavity, which cavity is designed to allow molding material to flow over the frame in selected spacial areas while at the same time allowing other selected areas of the frame to remain clear of the molding material. The final product is a dual construction of the frame and the molding material. As can be seen further in FIG. 4 the skeleton 12 includes ear hinges 18 connecting the ears 13, head hinge 20 connecting the head 11, arm hinges 22 connecting the arms 21 and leg hinges 24 connecting the legs 25 as part of the skeleton 12. These hinges may be formed by molding if the skeleton is molded or by stamping and forming during or subsequent to the blanking out of the skeleton if cut out of a sheet. "Polyhinges" are well known in the art and may be used thousands of times without failure. The typical specifications of these hinges include a thickness of about 0.008 to 0.015 inches at their center and a length of about 0.040 to 0.080 inches plus appropriate radii to avoid high stress points. Such hinges as utilized in the present invention define plastic springs tending to restore displacement of the joined elements such as, for example, the head 11 and the ears 13 of skeleton 12 through hinges 18, the arms 21 and body 23 joined by hinges 22 and legs 25 flexibly attached to the body 23 by hinges 24. The hinges will operate to restore these elements to the flat configuration if released from the folded configuration as, for example, between the position shown in FIG. 1A to that of FIG. 1. The invention fully contemplates supplementing, in certain embodiments, such spring action with supplemental metal hinge elements, to obtain a quicker and more forceful hinge action, as shown in FIG. 25. These spring supplements are intended to enhance the transformation from the inanimate closed configuration "C" of FIG. 1A to the animate open configuration "O" shown in FIG. 1, adding excitement and enjoyment to the toy.

Figure 5:
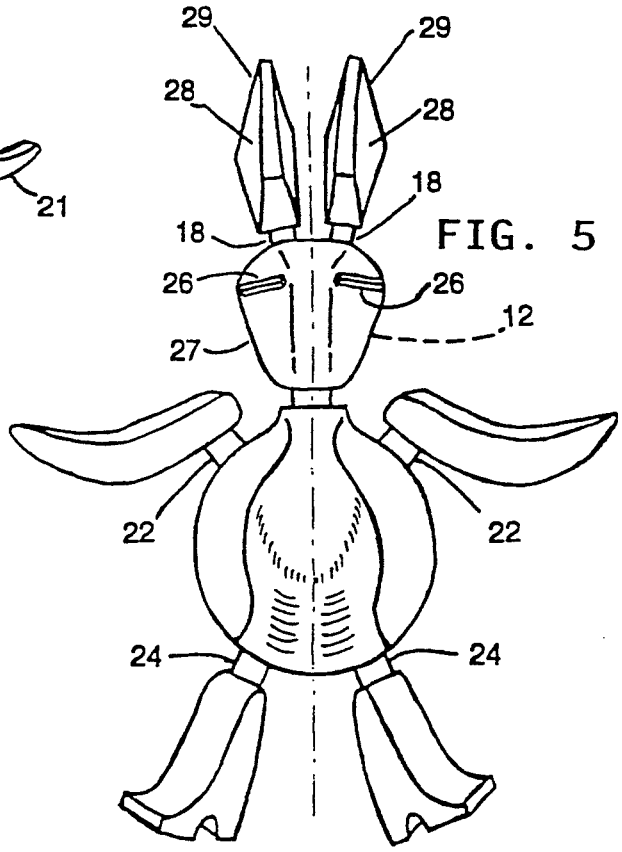
FIG. 5 is an elevational and partial perspective of the invention following forming of bulk material over the skeleton shown in FIG. 4 to define a three dimensional object.
Figure 6:
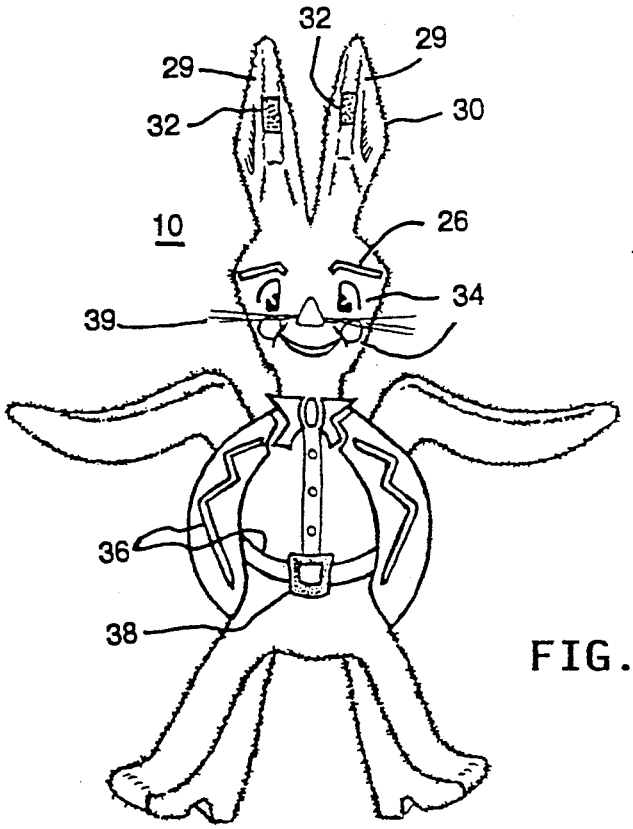
FIG. 6 is a view of the object shown in FIG. 5 with details in the form of a coating added thereto.

FIG. 5 shows a bulked up and three-dimensional configuration of a rabbit 10 provided by encapsulating or molding over the skeleton 12, with a resilient material such as silicon rubber, such bulking being shown as a formed head 27 having eyebrows 26 which protrude out from the rest of the head 27 and by the sloped surfaces 28 on the formed ears 29 on the rabbit toy 10. This aspect of the invention allows for three dimensional facial or other details to be highlighted through molding, forming or sculpting. The overmolding process, as described in the preceding paragraph regarding FIG. 4, is used to obtain the configuration of FIG. 5. This process allows the hinge areas to remain clear of the molding material such that their hinge action remains unaffected by the overmolding process. FIG. 6 shows the bulked up, three-dimensional configuration of FIG. 5 with exterior surface 30 in the form of a coating, flocking, or skin-like sewn cover or the like to simulate a furry exterior. Also shown in FIG. 6 is the addition of fastening means 32 to the formed and now covered ears 29 and facial details 34 which may include painted on or otherwise coated representations of details such as eyes and mouth on the surface of the bulking material. Additional detail in the form of a coat, tie and belt shown as 36 may be added to the body material and the invention contemplates the addition of a further fastener 38 to the body of rabbit toy 10. The fasteners 32 and 38 ma be of the hook and loop variety sold under the trademark "VELCRO" which engage and latch together under simple direct pressure, or there may be other types of fasteners including magnets, metal or plastic intermating snaps or traditional fasteners such as hook and eye or button types. The invention contemplates, as indicated in FIGS. 6, 7 and 8, that further detail may be added to the toy in the form of whiskers 39 stuck in and attached to the bulked up material of the toy.

Figure 7:
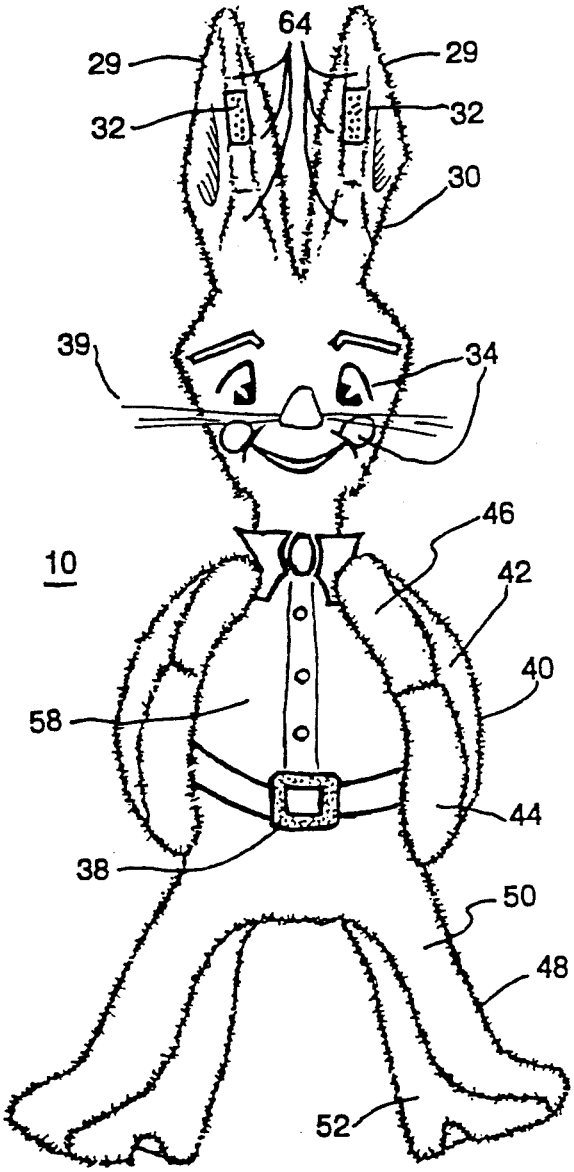
FIG. 7 is a view of the object shown in FIG. 6 in a first step of folding of appendages.
Figure 8:
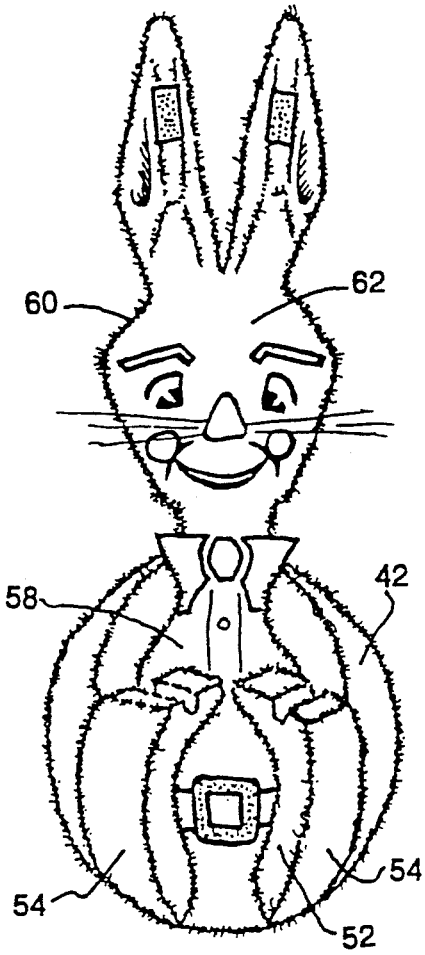
FIG. 8 is a view of the object shown in FIG. 7 with a second step of folding for configuration alteration.
Figure 9:
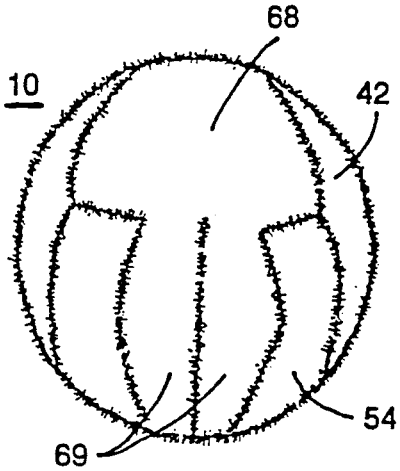
FIG. 9 is a view of the objects in FIGS. 7 and 8 following a final folding step to define the second or closed configuration of the invention toy.

FIGS. 7, 8 and 9 detail the transformation of the rabbit toy 10 as shown in FIGS. 1 and 6 to the inanimate and closed configuration shown in FIGS. 1A and 9. Important to an understanding of the invention is the provision of distinctly different surfaces which shall be termed interior and exterior. Referring to FIG. 7, typically the formed left arm 40 of the rabbit toy 10 may be seen to include an outer convex surface 42 which is an exterior surface and surfaces 44 and 46 which are interior surfaces (any surface not visible when the toy is in the closed configuration), such surfaces being visually apparent in FIG. 7 when the rabbit toy 10 is in the partially open animate configuration. These surfaces, 44 and 46, the interior surfaces, disappear upon closure by folding the appendages on their hinges to the configuration of FIG. 9. Also with respect to typically the rabbit toy 10 as shown in FIG. 7, the leg 48 includes an interior surface 50 and a further interior surface 52. The semi-folded condition in FIG. 8 shows only surface 52 and the fully folded up condition in FIG. 9 shows only the exterior surface 54, the surfaces 50 and 52 visually disappearing following folding enclosure. As can be seen in FIGS. 7 and 8, the body includes interior surfaces 58 covered over entirely upon the full folding in of the appendages relative to the body showing only their respective exterior surfaces. The head 60 includes interior facial surfaces 62 and the formed ears 29 typically include interior forwardly facing surfaces 64 which disappear when those appendages are folded into the position in FIG. 9 from the position of FIG. 8. To be noted is the alignment of the fasteners 32 on the forward interior surfaces of the ears, and fastener 38 on the belt buckle which latch together and hold toy 10 in the closed configuration of FIG. 9. Release from the inanimate ball-shaped image of FIG. 9 is initiated by pulling outwardly on the tips of the two ears which disengages fasteners 32 and 38. Peeling the appendages apart and separating these fasteners can result in the instant transformation of the toy from the ball enclosed surface shape of FIG. 9 to the open shape shown in FIG. 6, the hinges serving to result in an unfolding and opening up of the appendages. This transforms the toy from an inanimate generally spherical configuration having only exterior surfaces visible, suitable for play, throwing for example, to an animate open configuration in which both interior and exterior surfaces contribute to the toy's character. The degree and speed of opening can be made to range from a slow and steady opening to a dramatic "jack-in-the-box" opening by adjusting the strength of any spring construction formed in the hinges 18, 20, 22 and 24 of the skeleton 12.

FIG. 10 shows a side view of this transformation of the toy rabbit 10 with the interior surfaces 44, 46, 64, 62, 58 and 50 shown relative to the exterior surfaces 42, 69, 68, 70 and 54 shown in configuration 10A.

Figure 11:
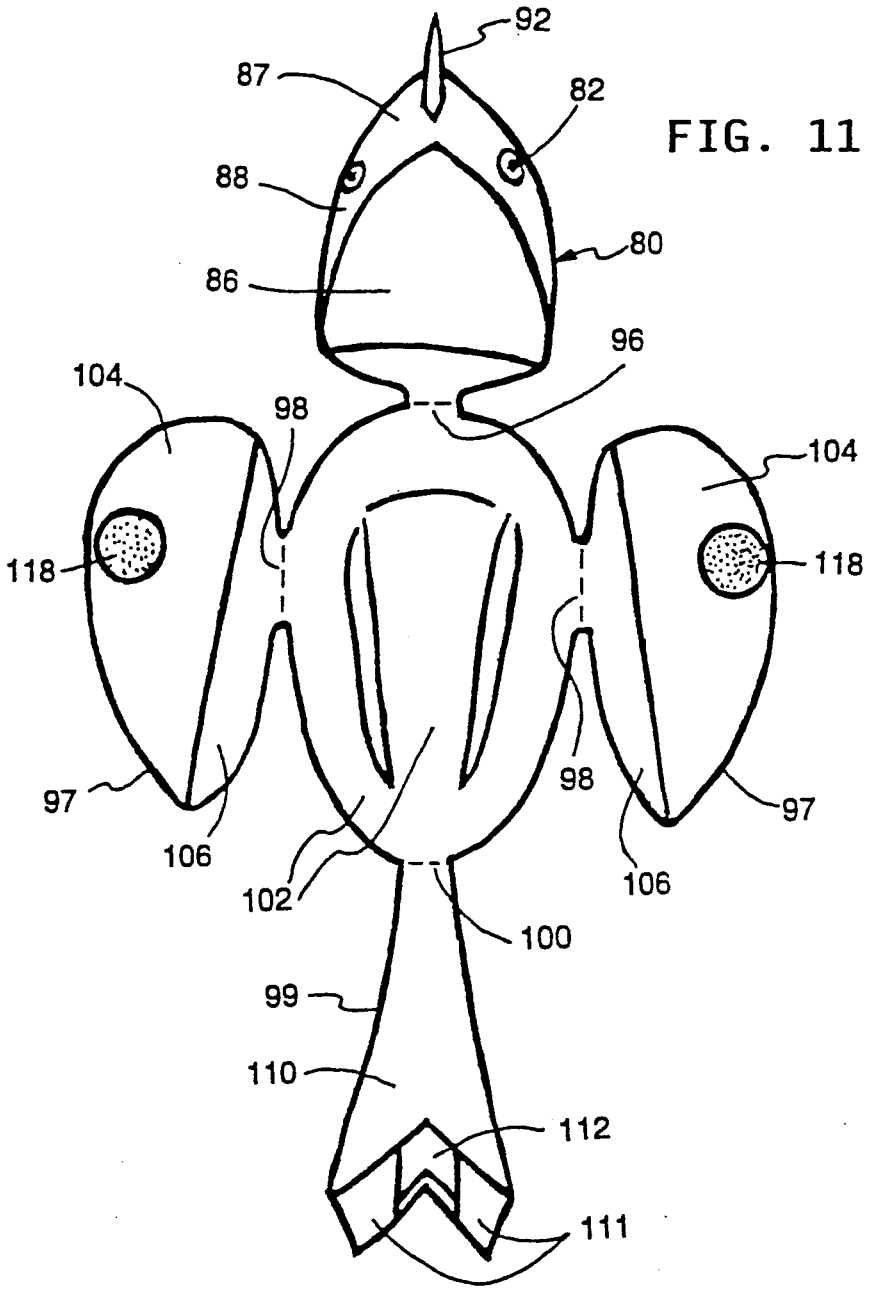
FIG. 11 is a bottom view showing the alternative toy configuration of FIG. 2 in an open position.
Figure 12:
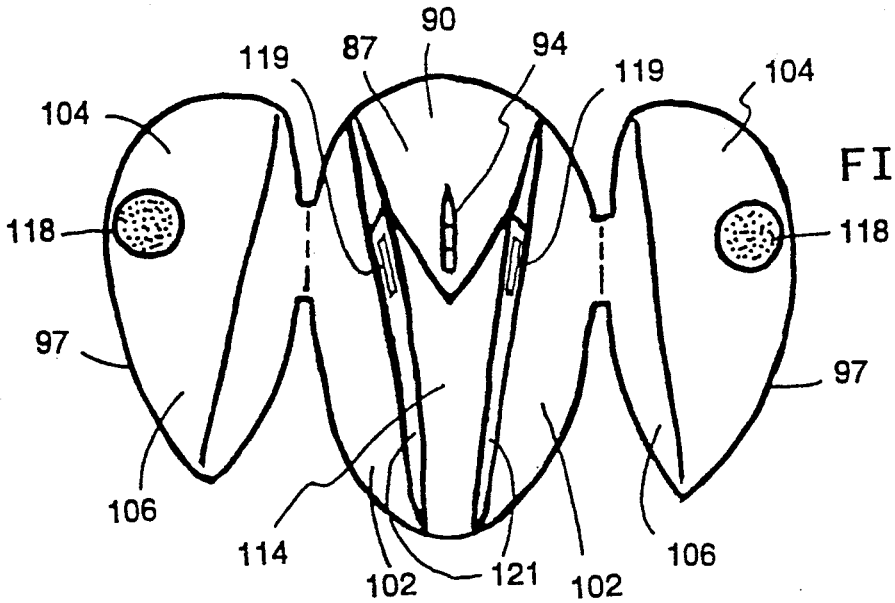
FIG. 12 is a view of the object of FIG. 11 following a first step of folding in closure.
Figure 13:
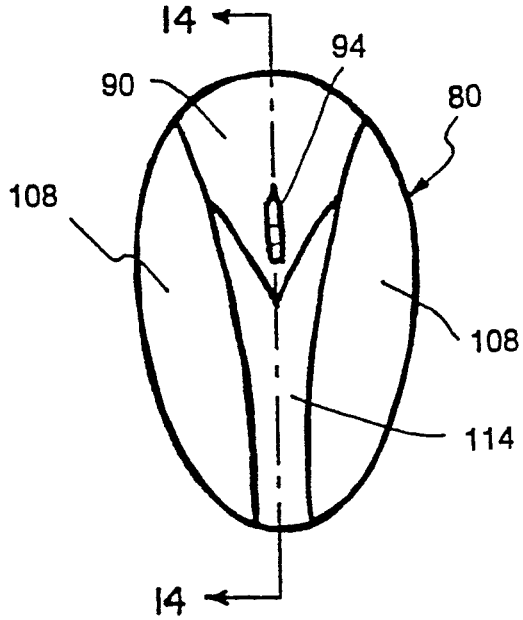
FIG. 13 is a view of the object of FIG. 12 following a second step of closure to define the closed configuration of the object shown in FIGS. 11 and 12.
Figure 14:
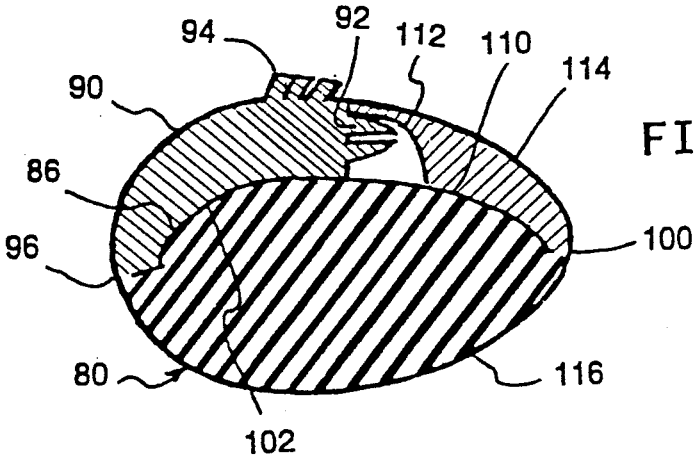
FIG. 14 is a section taken along lines 14—14 of the object shown in FIG. 13.

FIG. 11 shows a second illustrative embodiment of my invention in the form of a bird 80 from the bottom thereof, having detailed eyes 82 on the head 87 appendage having curvilinear interior surfaces 86 and 88, contrasting with exterior surfaces shown in FIGS. 12–14 including the head 87 having a top "exterior" surface 90. The head 87 further includes molded in details including a beak 92 and a comb 94 shown in FIGS. 11–14. A hinge 96 connects the head 87 appendage to the body of the bird 80. As can be seen in FIG. 11 the hinge 98 connects wing appendages 97 and hinge 100 connects the tail 99 appendage of the figure. The body of the bird 80 includes a curvilinear interior surface 102 and a curvilinear exterior back surface 116 shown in FIG. 14. Each of the wing appendages 97 include interior surfaces such as 104 and 106 shown in FIG. 11 and a curvilinear top exterior wing surface 108 shown in FIG. 13. The tail appendage 99 includes an interior surface 110 and two further interior surfaces 111 and 112 at the end of the tail, as shown in FIG. 11. Interior surface 112 is configured to fit over and cover up the beak 92, in the manner shown in FIGS. 13 and 14 when in the closed configuration. The tail appendage also includes on exterior curvilinear surface 114, as shown in FIGS. 13 and 14. Fasteners 118 are provided on the interior surfaces 104 of the wing appendages 97 of the bird 80 and fasteners 119 are provided on the side (internal) surface 121 of the tail 99 as shown in FIG. 12. FIGS. 11–14 show the folding sequence of the head 87, wing 97 and tail 99 appendages against the body to transform the bird figure from an animate configuration to an inanimate closed egg configuration, shown in FIG. 13. To be noted is the alignment of fasteners 118 on the interior wing surfaces and fasteners 119 on the interior (side) tail surfaces which latch together and hold toy 80 in the closed configuration of FIG. 13. The egg 80, which includes the curvilinear surfaces 90, 108, 114 and 116 may be unfolded from the inanimate image to restore the animate three-dimensional image. Release from the inanimate egg-shaped image of FIG. 13 is initiated by pulling outwardly on the comb 94 which sequentially moves the tail outwardly via the cam action of the beak 92 against the interior tail surface 112. This outward movement of the tail disengages fasteners 119 and fasteners 118 from one another. This transforms the toy from an inanimate egg-shaped configuration having only exterior surfaces visible, suitable for play, throwing for example, to an animate open configuration in which both interior and exterior surfaces contribute to the toy's character. The degree and speed of opening can be made to range from a slow and steady opening to a dramatic "jack-in-the-box" opening by adjusting the strength of any spring construction formed in the hinges 96, 98, and 100 of the FIG. 11.

Figure 15:
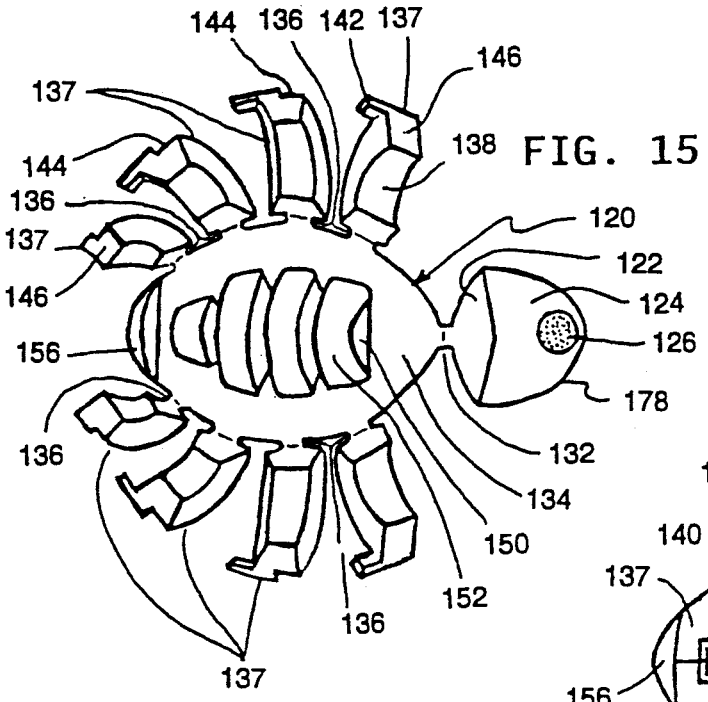
FIG. 15 is a bottom view showing the insect object of FIG. 3 in the open position.
Figure 16:
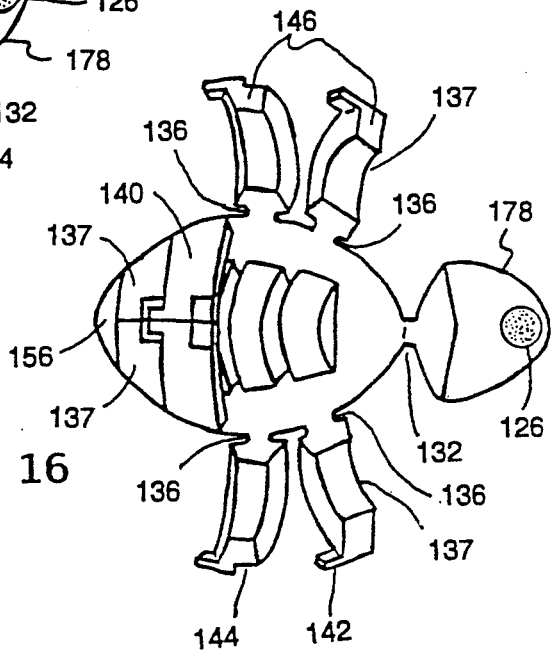
FIG. 16 is a vie w of the object of FIG. 15 following two steps of closure of appendages.
Figure 17:
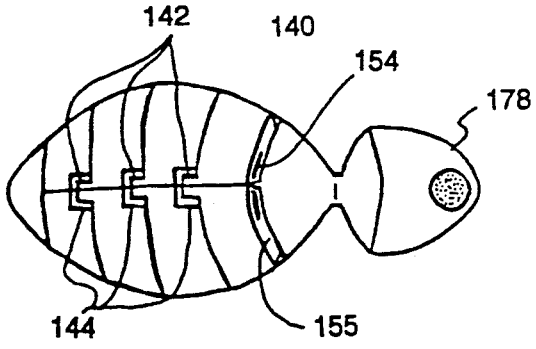
FIG. 17 is a view of the object of FIGS. 15 and 16 following two more folding closure steps.
Figure 18:
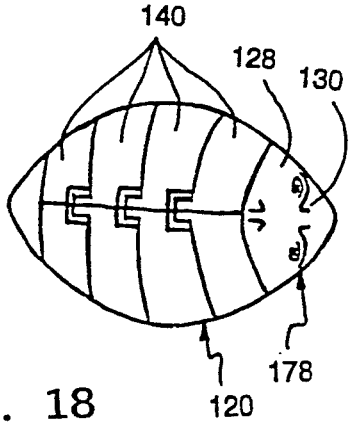
FIG. 18 is a view of the object of FIG. 17 following final closure and fastening to define the outside curvilinear, inanimate configuration.

Turning now to FIGS. 15–18 a third illustrative embodiment of my toy invention is shown in the form of an insect 120 including various head and leg appendages connected to the body. The head 180 has a lower side which includes interior surfaces 122 and 124, the latter surface carrying a fastener 126 that cooperates with fasteners 154 shown on the sides of the frontmost legs of the toy. FIG. 18 shows an exterior surface 128 containing details such as eyes and facial features 130. The head 180 is connected to the body by a hinge 132 and the body has a lower or bottom side which comprises interior surface 134. Hinges 136 connect each leg appendage 137, which legs 137 each have curvilinear interior surfaces 138, as shown in FIG. 15, and curvilinear exterior surfaces 140, as shown in FIGS. 16, 17 and 18. Each pair of legs has a distal surface 146 which is relatively flat such as the bottom of a foot would appear. The forward three pairs of legs each include distal rearward projections 142 which cooperate with recesses 144 which are shown on each of the three rearward pair of legs. The engagement of these projections and recesses on adjacent legs facilitate an internesting and locking-up of each pair of the legs 137 as they are sequentially folded in against the body. Central to the body and defining further interior surfaces on surface 134 are transverse, parallel, raised projections 150, having curvilinear surfaces 152 that provide a visual characterization of the belly of the insect 120. At the most rearward area of the body is a tail-like projection 156 which has an exterior curvilinear surface and a relatively flat interior surface and whose function is to appear tail-like but at the same time to complete the three dimensional shape shown in FIG. 3A. FIGS. 16–18 show the sequential folding of the legs 137 inwardly with the rearward projections 142 closing down against adjacent recess surfaces 144 to hold the preceding closed legs in position until, finally, the last or forward legs 137 are closed. The head 180 is then folded inwardly allowing the fastener 126 on the interior head surface 124 to connect to fasteners 154 on the inner forward surface 155 of the forwardmost pair of legs 137 as shown in FIG. 17 to complete the transformation from the animate object shown in FIG. 15 to the final inanimate object shown in FIG. 18. Release from the inanimate ellipsoid-like object is initiated by lifting outwardly on the head 178 (just below the nose) which disengages fastener 126 from fasteners 154. This transforms the toy from an inanimate ellipsoidal configuration having only exterior surfaces visible, suitable for play, throwing for example, to an animate open configuration in which both interior and exterior surfaces contribute to the toy's character. The degree and speed of opening can be made to range from a slow and steady opening to a dramatic "jack-in-the-box" opening by adjusting the strength of any spring Construction formed in the hinges 132 and 130 in FIG. 15.

Figure 19:
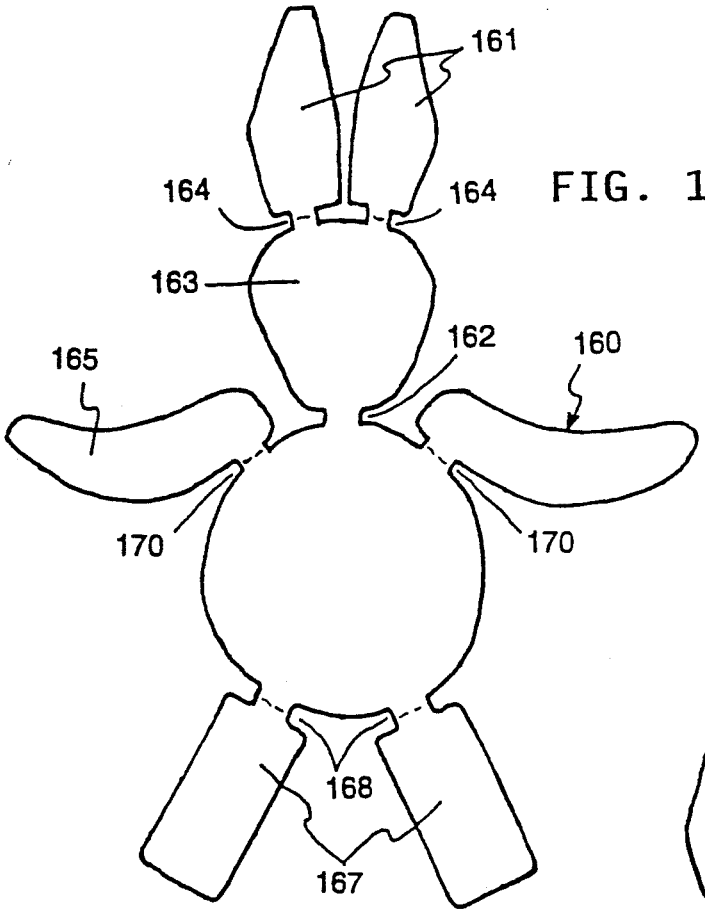
FIG. 19 is an elevational view of an alternative skeleton construction of the rabbit toy invention.
Figure 20:
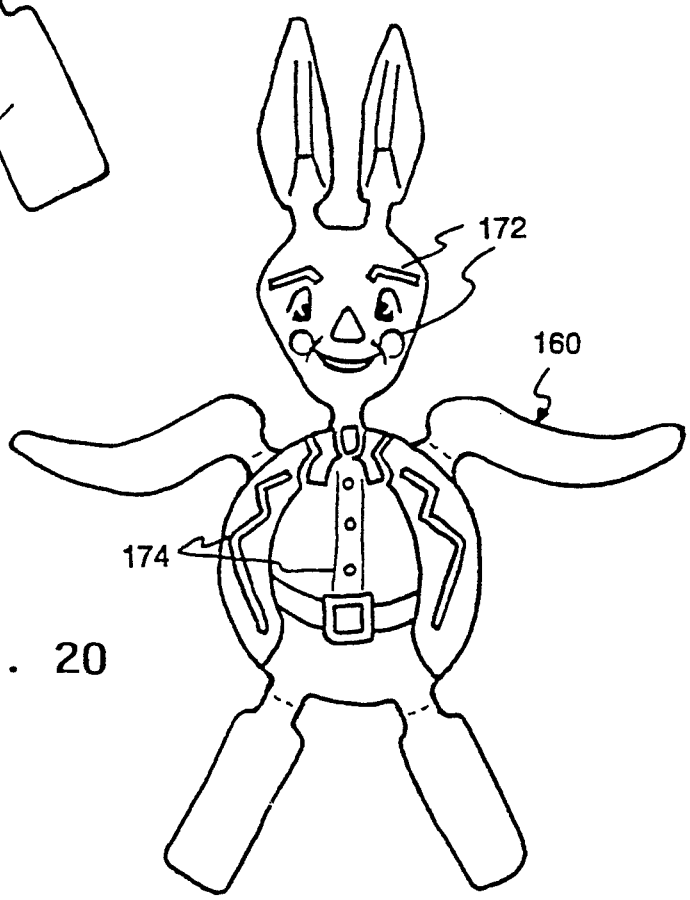
FIG. 20 is a view of the object shown in FIG. 19, the skeleton, following printing of detail in the flat state thereof.
Figure 21:
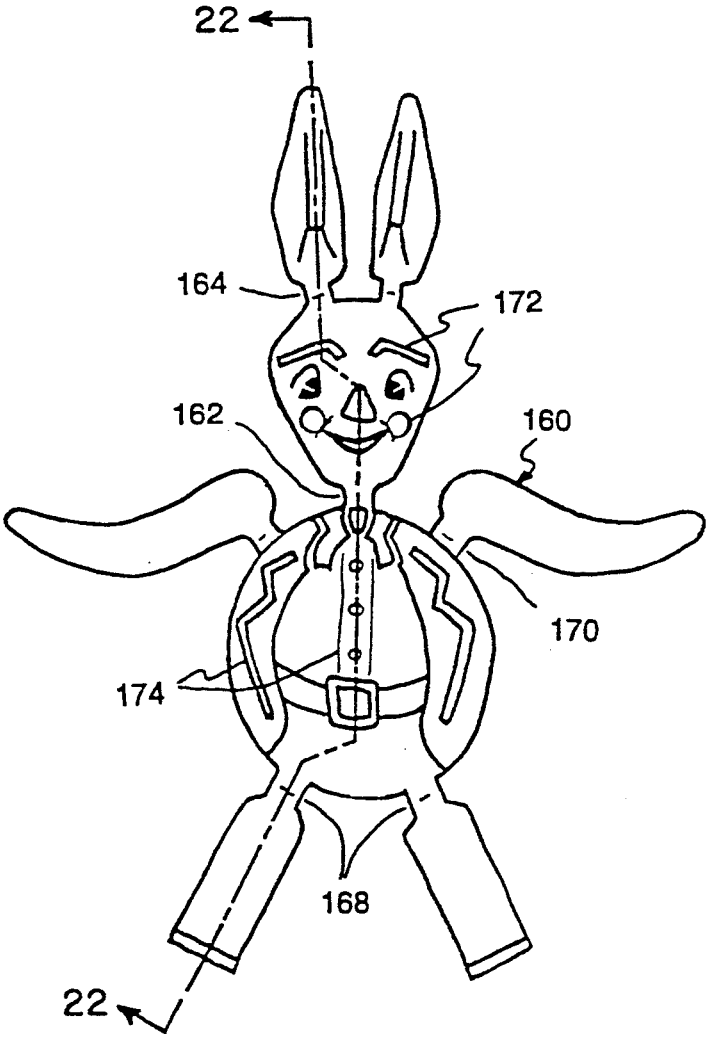
FIG. 21 is a view of the object of FIG. 20 following thermoforming of the skeleton to define a partial three dimensional structure.
Figure 24:
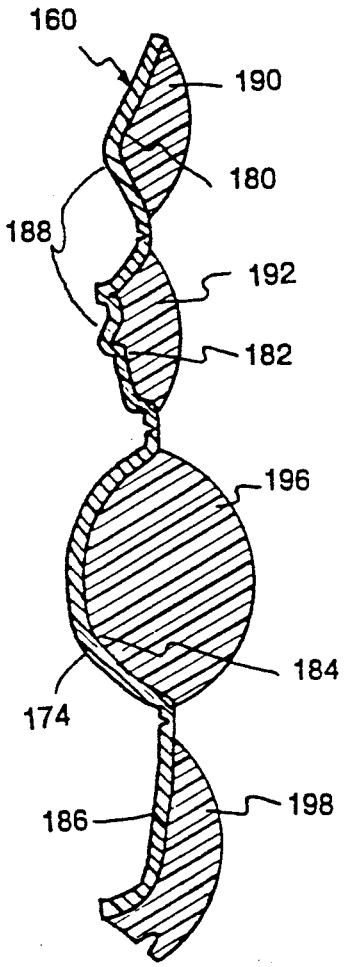
FIG. 24 is a sectional view taken along the lines 24—24 of the object as shown in FIG. 23.

FIGS. 19–24 show an alternative construction for the rabbit shown in FIG. 1 and embrace a different method of manufacture for toys. Referring to FIG. 19, outline profile skeleton 160 is made of sheet plastic material about 0.030 to 0.100 inches thick such as polypropylene to include resilient hinges 162, 164, 168 and 170 joining the various ear 161, head 163, arm 165 and leg 167 appendages to the body of the skeleton 160. The skeleton 160 is an exoskeleton or hard external surface onto which a soft body may be formed as shown in FIG. 24 and may be in the range of 2 to 8 inches in height, preferably. FIG. 20 shows the skeleton 160 having details 172 printed on the head appendage and details 174 printed on the body. These details are printed, silk-screened or otherwise deposited on the skeleton 160 in the flat condition and may be done either before or after the profiling of the skeleton if it is cut or stamped from flat stock or after forming if it is molded. The importance to manufacturing cost of being able to provide detail in the flat should be noted. FIG. 21 shows a view of the skeleton 160 following forming into the cross-sectional profile shown in FIG. 22, the section taken along lines 22—22 of FIG. 21. This forming can be done by thermoforming, a well known technique which preheats the relatively flat sheet of plastic material and then utilizes a set of dies to stretch and form the sheet into a three-dimensional shape. It is to be understood that the image details 172 and 174 and the paint or coating used must accommodate the deformation represented in FIGS. 21 and 22.

Figure 22:
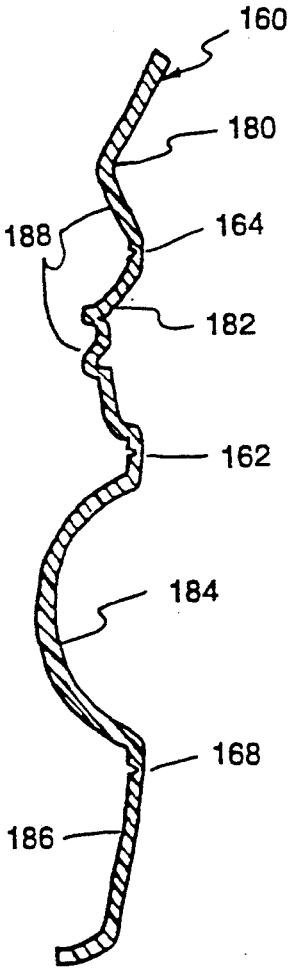
FIG. 22 is a side, sectional view taken along the lines 22—22 of the skeleton of FIG. 21.
Figure 23:
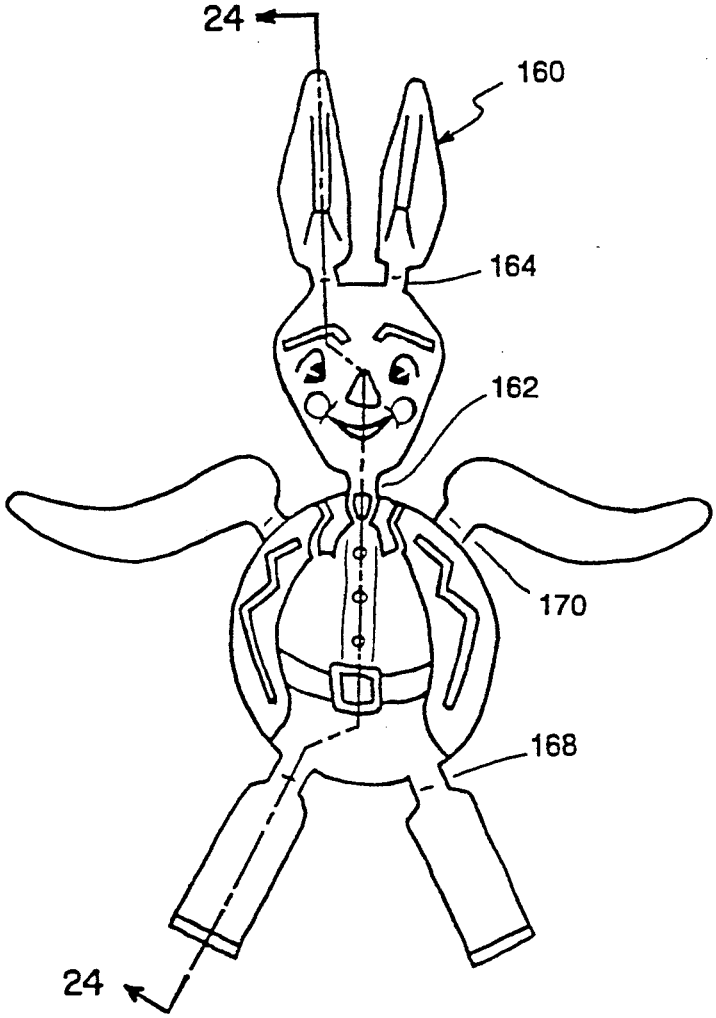
FIG. 23 is a view of the object of FIGS. 21 and 22 following forming thereon of a plastic material to provide bulk.

As can be seen in FIG. 22, the decorative details are displayed on the convex portions of the skeleton which is given a series of hollow portions including 180, 182 and 184 on the side opposite to the detail as well as curved configurations 186 and 188 on such detailed side. As can be seen in FIG. 22 specific three dimensional details such as the nose and eyebrows of the rabbit can be generated. FIG. 23 shows the rabbit image with the sections 24—24 being depicted in FIG. 24 to include the addition of bulk material to define the body and appendages formed on the various parts of the skeleton 160. The addition of bulk material is performed using the overmolding process which was explained in the description of FIG. 4. Plastic material 190, material 192, 196 and 198 is formed on the appendages and the body. In this way a three-dimensional transformable toy may be fabricated with a minimum of hand detailing of the figure. Suitable fasteners, not shown, would be added to the ears and to the belt buckle in the manner shown in FIG. 6 to facilitate the folding inward of the appendages to transform the toy from the animate form shown in the various figures to an inanimate form in the shape of a ball, like that in FIG. 1. As a matter of practice the skeleton 160 should be profiled large enough in area to accommodate thermoforming, with any excess of the profile trimmed after the thermoforming process shown in FIGS. 21 and 22, or following the overmolding process shown in FIGS. 23 and 24, depending on the design parameters of the final product. It is contemplated that the bulk material may be molded by various processes. One process utilizes a foamed in place plastic material within a mold which forms the exterior curvilinear surfaces on one side and on the other side supports the skeleton 160 by being a duplicate shape of skeleton 160. This is basically the same overmolding process which is explained in the description of FIG. 4. The resilience of the plastic material can be made to give the closed structure a degree of bounce for play enhancement.

FIG. 25 first shows a typical plastic hinge 72 with a pair of opposed depressions 73 and 74. FIG. 25 also shows one alternate embodiment of the hinges arranged between the body and it's appendages wherein an opening 75 is disposed through the center of the hinge 72. A coil spring 76 with opposed fingers 77 is disposed in the opening 75 such that the fingers 77 nest into a notch 78 adjacent the hinge. The coil spring 76 provides a biasing means to push the appendages away from the closed position next to the body to the open position directed away from the body.

The foregoing illustrative embodiments embracing figures having different characteristics transformable from animate, recognizable, creature-like objects to inanimate, generally smooth surfaced, curvilinear ball, egg shapes and football may be done for a host of transformable toys. By an appropriate selection of spring material including the plastic hinges or metal hinges, various rates of activation may be incorporated into such toys. As illustrated in the disclosure, the invention contemplates a host of different details by molding in features, by painting, coating, printing or otherwise illustrating the toy. Various finishes including flocking or other techniques to provide fur-like skins are contemplated and different manufacturing processes and constructions incorporating either endo or exoskeletons are contemplated. While the thrust of the invention is related to plastic skeletons and bulk for the body and appendages of the toys, other constructions may be employed including sewn, stitched or ultrasonically welded plastic or cloth material to yield elements of a fixed or semi-fixed configuration meaning that the geometrical shape of the elements remains essentially constant so that the parts can be easily and reliably folded together and unfolded again. Different kinds of hinges have been mentioned and are contemplated which may be incorporated into the alternate constructions. The foldability and internal spring features of toys embracing the concepts of the invention make the toy particularly attractive for younger children unable to manipulate toys having openings through which elements must be stuffed and drawn or toys which have varying shapes and require reasoned manipulation as typical of the prior art. The invention thus contributes to playing pleasure and education for the very young.

Having now disclosed and described the invention relative to drawings of illustrative embodiments the invention is defined in the appended claims:

I claim:

1. A three-dimensional toy transformable from an open configuration that visually simulates an animate object image such as an animal, creature or the like to a closed configuration such as a spheroid, egg or the like that simulates an inanimate object image;

said toy including parts defining body, appendages and foldable flat plastic hinges operable to allow such parts to be folded inwardly to define the closed configuration and folded outwardly to define the open configuration;

each of said parts being comprised of semi-riged material to define fixed geometry, three-dimensional shapes with a curvilinear surface defining the exterior surface and the inanimate image;

each of said parts also having an interior surface defining the details of the animate object image with each of said surfaces shaped to allow said parts to fit together upon being folded into the closed configuration to essentially fill the interior of said toy producing a generally semi-solid structure to allow handling for play;

a hook or loop fastener means operable to releasibly hold said toy in the closed configuration and to permit release of such parts to the open configuration;

both said exterior and interior surfaces having details defined by coated portions of the animate image.

2. The toy as recited in 1 wherein at least one of said hinges has a spring element operable to store energy upon closure of said parts together and to drive such parts open upon release of said fastener means.

3. The toy as recited in 1 wherein said hinges are spring elements.

4. A toy which is transformable from a first three dimensional shape having a generally smooth curvilinear outer surface, into a second shape of recognizable character having a central body portion;

said character having a plurality of appendages atriculably arranged thereon;

each of said appendages having a foldable flat plastic hinge connecting said appendage to said body;

said body portion and at least one of said appendages having a least one curvilinear surface thereon which comprises at least a portion of said generally smooth curvilinear outer surface of said first three dimensional shape, thus permitting the folding of said appendages about said body to transform said toy from one shape to another shape easily;

said body and at least one of said appendages have a front surface which permits their close mating when said toy is folded into said first shape having said curvilinear outer surface;

said front surface of said body and at least one of said appendages has decorative features thereon to suggest said recognizable character onto said toy;

each of said hinges having a width greater than its thickness, said hinges having a spring means there-with, to store and release energy when said appendages are folded to and from the first shape of the toy, respectively; and said body having a single unitary skeleton formed from a flat plastic sheet material which is internal to the body and at least one of said appendages.

5. The toy as recited in 1 wherein an animate detail is printed on said skeleton.

6. The toy as recited in 1 wherein said hinges are formed of an integral piece of plastic material.

7. The toy as recited in 1 wherein said body, appendages and hinges include an integral piece of plastic material defining a skeleton for such toy having an additional layer of material added which forms a bulk to provide a three-dimensional aspect to said toy.

8. A three-dimensional toy transformable from an open to a closed configuration defining a body and appendages including visually distinct features such as a head, arms or legs;

a foldable flat plastic hinge joining said body and each of said appendages together to facilitate a folding of said appendages inwardly against said body to permit a simple arcuate movement therebetween allowing the appendages to nest together;

said body and appendages having an exterior arcuate surface defining an essentially smooth object which is substantially featureless and an interior surface which is animately detailed;

a fastener means to hold the toy in a closed configuration and operable upon release to allow said appendages to open away from said body;

at least one of said appendages having a projection which defines a surface operable to hold an adjacent appendage in the closed configuration; and spring means operable to cause said toy to pop open from the closed condition to the open condition upon release of said fastener means.

9. A toy which is transformable from a first curvilinear featureless three dimensional shape into a second animatable character configuration having a head, a body and at least one other appendage;

a foldable flat plastic hinge arranged between said body and said head and said at least one other appendage to permit movable transformation between said first shape and said second configuration;

a securement means disposed on said head or said at least one other appendage to hold said head or appendage in a nested manner against said body in it's first shape orientation; said head, said body and said appendage having at least one outer curvilinear surface which contributes to the total surface of said first curvilinear shape;

said body and said appendage having at least one inner curvilinear surface which does not comprise the outer surface of said first curvilinear shape, said inner curvilinear surface of said head, body and appendage being cooperatively shaped to permit nestable mating therebetween when said toy is in it's first shape;

said cooperatively shaped inner and outer curvilinear surfaces having an overlapping arrangement so as to permit either said head or appendage to hold the other in said nested first shape.

* * * * *